US011773757B2

(12) United States Patent
Wang et al.

(10) Patent No.: US 11,773,757 B2
(45) Date of Patent: Oct. 3, 2023

(54) COMPRESSION RELEASE ENGINE IN-CYLINDER BRAKING SYSTEM

(71) Applicant: WEIFANG LICHUANG ELECTRONIC TECHNOLOGY CO., LTD, Weifang (CN)

(72) Inventors: Lifeng Wang, Weifang (CN); Xiuqiang Wang, Weifang (CN)

(73) Assignee: WEIFANG LICHUANG ELECTRONIC TECHNOLOGY CO., LTD, Weifang (CN)

( * ) Notice: Subject to any disclaimer, the term of this patent is extended or adjusted under 35 U.S.C. 154(b) by 0 days.

(21) Appl. No.: 17/795,512

(22) PCT Filed: Dec. 29, 2020

(86) PCT No.: PCT/CN2020/140633
§ 371 (c)(1),
(2) Date: Jul. 26, 2022

(87) PCT Pub. No.: WO2021/169566
PCT Pub. Date: Sep. 2, 2021

(65) Prior Publication Data

US 2023/0075743 A1 Mar. 9, 2023

(30) Foreign Application Priority Data

Feb. 28, 2020 (CN) ..... 202010129630.4

(51) Int. Cl.
*F01L 9/10* (2021.01)
*F01L 13/06* (2006.01)
(Continued)

(52) U.S. Cl.
CPC ..... *F01L 9/10* (2021.01); *F01L 1/146* (2013.01); *F01L 1/181* (2013.01); *F01L 9/12* (2021.01);
(Continued)

(58) Field of Classification Search
CPC ..... F01L 9/10; F01L 9/12; F01L 9/16; F01L 13/06; F01L 1/146; F01L 1/181; F02D 13/04
See application file for complete search history.

(56) References Cited

U.S. PATENT DOCUMENTS 5,746,175 A * 5/1998 Hu ..... F01L 9/11 123/90.12

FOREIGN PATENT DOCUMENTS

CN 102165149 8/2011
CN 103334809 10/2013
(Continued)

OTHER PUBLICATIONS

International Search Report for corresponding International Patent Application No. PCT/CN2020/140633, dated Mar. 25, 2021.

*Primary Examiner* — Loren C Edwards
(74) *Attorney, Agent, or Firm* — Michael F. Fedrick; LOZA & LOZA, LLP

(57) ABSTRACT

A compression release engine in-cylinder braking system, comprising a valve mechanism, an oil cylinder device, an oil pump device, and an oil supply device. The oil cylinder device and the oil pump device of each air cylinder communicate with each other through a pressure transmission oil circuit, which communicates with the oil supply device through a low-pressure relief valve. An air release valve is arranged at the high end of an oil circuit system. During in-cylinder braking, the air release valve is closed, an electromagnetic reversing valve is energized, engine oil having a pressure of P1 is supplied to the pressure transmission oil circuit, and a cam abuts against and pushes the oil pump device to pump high-pressure oil to the oil cylinder device, so as to push a rocker arm to open a valve, thereby achieving in-cylinder braking.

11 Claims, 6 Drawing Sheets

(51) Int. Cl.

| | |
|---|---|
| ***F01L 1/14*** | (2006.01) |
| ***F01L 1/18*** | (2006.01) |
| ***F01L 9/12*** | (2021.01) |
| ***F02D 13/04*** | (2006.01) |
| *F01L 9/16* | (2021.01) |

(52) U.S. Cl.
CPC ..... *F01L 13/06* (2013.01); *F02D 13/04* (2013.01); *F01L 9/16* (2021.01)

(56) References Cited

FOREIGN PATENT DOCUMENTS

| | | |
|---|---|---|
| CN | 110700917 | 1/2020 |
| CN | 111197510 | 5/2020 |
| CN | 211666789 | 10/2020 |

* cited by examiner

COMPRESSION RELEASE ENGINE IN-CYLINDER BRAKING SYSTEM

CROSS-REFERENCE TO RELATED APPLICATIONS

This application is the U.S. national stage of International Patent Application No. PCT/CN2020/140633, filed on Dec. 29, 2020, which claims the benefit of priority under 35 U.S.C. § 119 to Chinese patent application No. 202010129630.4, filed on Feb. 28, 2020, and entitled "COMPRESSION RELEASE ENGINE IN-CYLINDER BRAKING SYSTEM". The disclosures of the foregoing applications are incorporated herein by reference in their entirety.

FIELD

The present invention relates to the technical field of a variable valve of an engine, and in particular, to a compression release engine in-cylinder braking system.

BACKGROUND

During the normal operation of the engine, the engine completes four working cycles of intake, compression, power and exhaust for every 360° rotation of the camshaft. At the end of the compression stroke, the fuel burns in the air cylinder, and does external work in the subsequent expansion stroke.

The engine in-cylinder braking is a form of vehicle auxiliary braking. The contribution of the engine in-cylinder braking is that the braking capability of the whole vehicle can be improved and the braking load of a main braking of the whole vehicle can be reduced. During engine in-cylinder braking, the engine does negative work externally in the compression stroke. When the compression stroke is close to a top dead center, under the driving of the engine in-cylinder braking device, the exhaust valve is opened for a small lift for rapidly releasing the compressed high-pressure gas in the air cylinder, and the pressure in the air cylinder is reduced rapidly to reduce the energy of the power stroke; therefore, in the subsequent power stroke, the engine basically does not do work externally, so that the engine is decelerated and the engine in-cylinder braking aim is fulfilled.

The Chinese utility model patent with the publication number of CN201241740Y and the title of "FOUR-STROKE INTERNAL COMBUSTION ENGINE AND ROCKER ARM INTEGRATED BRAKING DEVICE" discloses an engine in-cylinder braking device. Two braking protrusions are arranged on an exhaust cam, and is used to open an intake valve before the end of the intake stroke to increase the air intake and used to open an exhaust valve before the end of the compression stroke to release pressure to realize in-cylinder braking of the engine. In order to balance out the valve lift caused by the braking protrusions during normal operation of the engine, it is necessary to arrange a hydraulically-controlled clearance compensation mechanism on the rocker arm. Since the normal operation state accounts for the vast majority of the operation state of the whole engine, the clearance compensation mechanism is in the working state in most of the operation time of the engine, higher requirements are put forward on reliability, and the structure is complicated.

Therefore, the applicant developed a new engine in-cylinder braking device and submitted the patent application with the publication number of CN110566309A and the title of "COMPRESSION RELEASE ENGINE IN-CYLINDER BRAKING DEVICE". However, in the subsequent practical application, the applicant found the following problems which need to be further improved: the structure is too complicated and only can be applied to a multi-cylinder engine with even-numbered engine cylinders, and it is required that each cylinder of the engine must have a corresponding cylinder with a phase of 360° crank angle, so the application is limited.

Therefore, the applicant developed a new engine in-cylinder braking system and submitted the patent application (referred to as the original application) with the application number of 201911383008.X and the title of "COMPRESSION RELEASE ENGINE IN-CYLINDER BRAKING SYSTEM". However, in the subsequent practical application, the applicant found that the patent technology has the following problems which need to be further improved: since a pressure transmission oil circuit communicating with the oil cylinder device and the oil pump device is provided corresponding to each air cylinder of the engine, the pressure transmission oil circuit needs to be connected to one shared oil supply device through a one-way valve to supply the engine oil during in-cylinder braking and also needs to be connected to a low-pressure relief oil circuit to release the engine oil in the pressure transmission oil circuit after the in-cylinder braking is completed, the pressure is reduced, and it is convenient for the oil supply device to supplement the engine oil to the pressure transmission oil circuit; and in the in-cylinder braking system, there are many hydraulic elements for oil supply and pressure relief, and the oil circuit structure is too complicated.

After this, the applicant performed further development and submitted the patent application (referred to as the previous patent) with the application number of 202010031654.6 and the title of "COMPRESSION RELEASE ENGINE IN-CYLINDER BRAKING SYSTEM"; however, in the subsequent practical application, the applicant found that the previous patent technology at least has the following problems which need to be further improved:

- since the system transmits power through hydraulic oil, when the engine is shut down, it is extremely easy for the air to enter the pressure transmission oil circuit, thereby seriously affecting the power transmission effect.

The oil pump device is provided with a plunger sleeve buffer oil hole 212. The impact caused by sudden contact between the cam 16 and the top surface of the oil pump device II can be reduced through the discharge buffer of the plunger sleeve buffer oil hole 212, but since oil is pumped after the camshaft drives the oil pump device to block the plunger sleeve buffer oil hole 212, the size of the oil pump stroke is controlled by the camshaft profile and is also affected by the position of the plunger sleeve buffer oil hole 212, resulting in low control precision; furthermore, each plunger sleeve buffer oil hole 212 is connected to the respective overflow pressure-retaining valve 300, resulting in a large number of valves and complicated system structure.

In addition, in the previous patent, in the engine compression release mode, when the oil pump device starts to work, a part of high-pressure oil will inevitably return to the engine oil circuit L0 (that is, the main engine oil circuit of the engine) through the low-pressure relief valve 90, thereby impacting the engine oil circuit L0.

SUMMARY

In view of this, the technical problem to be solved by the present invention is to provide a compression release engine in-cylinder braking system, so that the power transmission effect of the oil circuit is ensured, the structure of the oil circuit is high, the failure rate is low, and the application performance is high and is not limited by the number of the engine cylinders.

To solve the above technical problem, the technical solution of the present invention is: a compression release engine in-cylinder braking system is applied to a valve mechanism of the engine and comprises: an oil cylinder device, an oil pump device and an oil supply device, wherein all air cylinders of the engine share the oil supply device;

the valve mechanism comprises a camshaft, a rocker arm and a valve, and the camshaft is provided with a cam;

the oil supply device comprises an electromagnetic reversing valve, an oil supply oil circuit, a pressure reduction oil circuit and a pressure relief oil circuit, an overflow pressure-retaining valve is arranged in the pressure relief oil circuit, the engine oil pressure of the engine before pressure reduction is defined as P1, and the engine oil pressure of the engine after pressure reduction is defined as P2;

each of the air cylinders is provided with the oil cylinder device and the oil pump device, the oil cylinder device communicates with the oil pump device through a pressure transmission oil circuit, and the pressure transmission oil circuit communicates with the oil supply oil circuit through a low-pressure relief valve;

an air release valve is arranged at a high end of an oil circuit system;

during in-cylinder braking, the air release valve is closed, the electromagnetic reversing valve is energized, and engine oil having a pressure of P1 is supplied to the pressure transmission oil circuit through the oil supply oil circuit; the cam abuts against and pushes the oil pump device, the pressure of engine oil in the oil pump device increases, the oil pump device pumps high-pressure engine oil having a pressure of P to the oil cylinder device through the pressure transmission oil circuit, and the oil cylinder device pushes the rocker arm to open the valve;

during non-in-cylinder braking, the air release valve is opened, the electromagnetic reversing valve is de-energized, and engine oil having a pressure of P2 is supplied to the pressure transmission oil circuit through the oil supply oil circuit; the oil cylinder device and the oil pump device return respectively, and the cam is out of contact with the oil pump device;

when the oil pump device works, the low-pressure relief valve is closed; when the oil pump device does not work, the low-pressure relief valve is opened; and an opening pressure difference of the low-pressure relief valve is greater than P1, and the opening pressure difference of the low-pressure relief valve is less than P.

The air release valve comprises:

a valve body, provided with a valve body oil port I and a valve body oil port II which communicate with a valve cavity of the valve body, wherein the valve body oil port I is connected to the pressure transmission oil circuit and the valve body oil port II is connected to an oil pan of the engine;

a valve ball, arranged in the valve cavity;

a compression spring, arranged in the valve cavity and clamped between the valve ball and the valve body oil port II; and limiting pin, arranged on the valve body and located between the valve body oil port I and the valve ball, wherein an elastic force of the compression spring of the air release valve on the valve ball is greater than an acting force of the engine oil pressure P2 of the engine after pressure reduction on the valve ball and is less than an acting force of the engine oil pressure P1 of the engine before pressure reduction on the valve ball.

Further, a throttling hole is arranged behind the air release valve, and the throttling hole communicates with the oil pan of the engine. The throttling hole is provided, so that the oil discharging speed can be controlled, and waste of hydraulic oil is avoided.

The oil circuits of various cylinders between the low-pressure relief valve and the oil supply oil circuit are jointly connected to one high-pressure overflow pressure-retaining valve, and the high-pressure overflow pressure-retaining valve communicates with the oil pan of the engine.

A one-way valve is connected in front of the electromagnetic reversing valve. The one-way valve is provided, so that the main oil circuit of the engine can be further protected from being impacted by the returned high-pressure engine oil.

The throttling hole is arranged in the pressure reduction oil circuit. Under the condition of reducing the pressure of the engine oil, compared with the pressure reduction valve, the structure adopting the throttling hole is simpler.

The oil pump device comprises:

a plunger sleeve, wherein the bottom of the plunger sleeve is closed, the top of the plunger sleeve is open, a plunger sleeve oil inlet and outlet hole is formed in a sleeve wall of the plunger sleeve, and the plunger sleeve oil inlet and outlet hole is connected to the pressure transmission oil circuit;

a plunger, slidably arranged in an inner cavity of the plunger sleeve, wherein a plunger sleeve oil cavity is formed between the bottom of the plunger and the bottom of the plunger sleeve, the plunger sleeve oil inlet and outlet hole communicates with the plunger sleeve oil cavity, the top of the plunger extends out of the opening of the plunger sleeve, the top of the plunger is in contact with the cam during in-cylinder braking, and the top of the plunger is out of contact with the cam during non-in-cylinder braking; and a plunger tension spring, located in the plunger sleeve oil cavity and connected between the bottom of the plunger sleeve and the bottom of the plunger, wherein a plunger limiting device is arranged at the open end of the plunger sleeve; the plunger comprises a plunger large-diameter section located in the inner cavity of the plunger sleeve and a plunger small-diameter section connected to the plunger large-diameter section; a plunger step is formed at the transition position of the plunger large-diameter section and the plunger small-diameter section; during in-cylinder braking, the plunger limiting device limits the plunger step;

the plunger further comprises a plunger abutting section located outside the plunger sleeve and connected to the plunger small-diameter section; during in-cylinder braking, a top surface of the plunger abutting section abuts against the cam; and during non-in-cylinder braking, the top surface of the plunger abutting section is out of contact with the cam, and the plunger limiting device limits the plunger abutting section.

The top surface of the plunger abutting section is a flat surface or a cambered surface.

The oil cylinder device comprises:

a cylinder body, wherein the top of the cylinder body is closed, the bottom of the cylinder body is open, a cylinder body oil inlet and outlet hole is formed in a cylinder wall of the cylinder body, and the cylinder body oil inlet and outlet hole is connected to the pressure transmission oil circuit;

a piston, slidably arranged in an inner cavity of the cylinder body, wherein a cylinder body oil cavity is formed between the top of the piston and the top of the cylinder body, the cylinder body oil inlet and outlet hole communicates with the cylinder body oil cavity, a piston rod is arranged at the bottom of the piston, the piston rod extends out of the opening of the cylinder body, the bottom of the piston rod is in contact with the rocker arm and presses down the rocker arm to open the valve during in-cylinder braking, and the bottom of the piston rod is out of contact with the rocker arm during non-in-cylinder braking; and a piston tension spring, located in the cylinder body oil cavity and connected between the top of the cylinder body and the top of the piston, wherein a cylinder body oil-discharging hole is formed in the cylinder wall of the cylinder body, the cylinder body oil-discharging hole communicates with the oil pan of the engine; during in-cylinder braking, the piston moves downward, and the cylinder body oil-discharging hole does not communicate with the cylinder body oil cavity when the oil pump device works; when the cam pushes the valve open by means of the valve mechanism and the oil pump device does not work, the cylinder body oil-discharging hole communicates with the cylinder body oil cavity; during non-in-cylinder braking, the piston plugs the cylinder body oil-discharging hole under the action of the piston tension spring;

a piston limiting device is arranged at the open end of the cylinder body; a piston step is formed at the transition position of the piston and the piston rod; when the oil pump device works during in-cylinder braking, the piston limiting device does not limit the piston step, and a distance between the piston step and the piston limiting device is S and S>0; and when the cam pushes the valve open by means of the valve mechanism and the oil pump device does not work, the piston limiting device limits the piston step, and S=0.

The low-pressure relief valve comprises:

a valve body, provided with a valve body oil port I and a valve body oil port II which communicate with a valve cavity of the valve body, wherein the valve body oil port I is connected to the pressure transmission oil circuit and the valve body oil port II is connected to the oil supply oil circuit;

a valve ball, arranged in the valve cavity;

a compression spring, arranged in the valve cavity and clamped between the valve ball and the valve body oil port II; and a limiting pin, arranged on the valve body and located between the valve body oil port I and the valve ball.

The cam is an exhaust cam; or the cam is an intake cam; or the cam is a single-cylinder braking cam.

The cam can also be a total braking cam, the oil pump device is arranged at the periphery of the total braking cam, and the number of the oil pump devices is the same as the number of the air cylinders of the engine.

The electromagnetic reversing valve is a two-position three-way electromagnetic reversing valve.

After the above technical solution is adopted, the present invention has the following beneficial effects:

the compression release engine in-cylinder braking system provided by the present invention comprises an oil cylinder device, an oil pump device and an oil supply device that are applied to a valve mechanism of the engine, wherein all air cylinders of the engine share the oil supply device; the oil supply device comprises an electromagnetic reversing valve, an oil supply oil circuit, a pressure reduction oil circuit and a pressure relief oil circuit, the engine oil pressure of the engine before pressure reduction is P1, and the engine oil pressure of the engine after pressure reduction is P2; each air cylinder of the engine is provided with an oil cylinder device and an oil pump device, the oil cylinder device communicates with the oil pump device through a pressure transmission oil circuit, the pressure transmission oil circuit communicates with the oil supply oil circuit through a low-pressure relief valve, and an air release valve is arranged at a high end of an oil circuit system; during in-cylinder braking, the air release valve is closed, the electromagnetic reversing valve is energized, the engine oil having a pressure of P1 is supplied to the pressure transmission oil circuit through the oil supply oil circuit, and a piston of the oil cylinder device and a plunger of the oil pump device extend out; when a cam abuts against and pushes the oil pump device, the pressure of engine oil in the oil pump device increases, the oil pump device pumps high-pressure engine oil having a pressure of P to the oil cylinder device through the pressure transmission oil circuit, the low-pressure relief valve is closed, the oil cylinder device pushes a rocker arm to open a valve to realize in-cylinder braking; and during non-in-cylinder braking, the air release valve is opened, the electromagnetic reversing valve is de-energized, engine oil having a pressure of P2 is supplied to the pressure transmission oil circuit through the oil supply oil circuit; and at the moment when the electromagnetic reversing valve is de-energized, the low-pressure relief valve is in an open state, oil pressure in the pressure transmission oil circuit is relieved through the low-pressure relief valve and reduced to P2, the oil cylinder device and the oil pump device return respectively, the cam is out of contact with the oil pump device, the engine is in a normal operation state, and the engine oil or air in the pressure transmission oil circuit is discharged continuously through the air release valve, so that the problem that the power transmission effect is seriously affected by the fact that air enters the pressure transmission oil circuit in the shut-down state is solved. Since each air cylinder of the engine is provided with the oil cylinder device and the oil pump device which are connected through the pressure transmission oil circuit, the pressure transmission oil circuit communicates with the oil supply oil circuit of the oil supply device through the low-pressure relief valve, braking/non-braking conversion for all the air cylinders of the whole engine can be realized only by controlling on/off of the electromagnetic reversing valve, and the requirement on the control circuit is low, working is stable and reliable and the failure rate is low; furthermore, the compression release engine in-cylinder braking system is simple in structure and flexible and convenient in arrangement, is not limited by the number of the engine cylinders (even and odd numbers are both acceptable), has high application performance and is applied more widely.

In the present invention, the plunger sleeve buffer oil hole of the oil pump device of each cylinder and the overflow pressure-retaining valve connected thereto in the previous patent are omitted, the oil circuits of various cylinders between the low-pressure relief valve and the oil supply oil circuit are jointly connected to one high-pressure overflow pressure-retaining valve. In the engine compression release mode, when the oil pump device starts to work, a part of high-pressure engine oil will inevitably return to the main engine oil circuit of the engine through the low-pressure relief valve, resulting in causing impact on the main engine oil circuit of the engine. In the present invention, the returned high-pressure engine oil can be discharged by means of the high-pressure overflow pressure-retaining valve, thereby avoiding impact on the main engine oil circuit of the engine; furthermore, the present invention only needs to be provided with one high-pressure overflow pressure-retaining valve, the previous patent is provided with a plurality of overflow pressure-retaining valves with the same number as the air cylinders of the engine. In the present invention, the number of the valves is greatly reduced and the structure of the oil circuit system is simpler; moreover, since the plunger sleeve buffer oil hole of the oil pump device of each cylinder in the previous patent is omitted, in the present invention, the oil pump stroke of the oil pump device is completely determined by the cam shape of the camshaft, and the control precision is higher.

Figure 1:
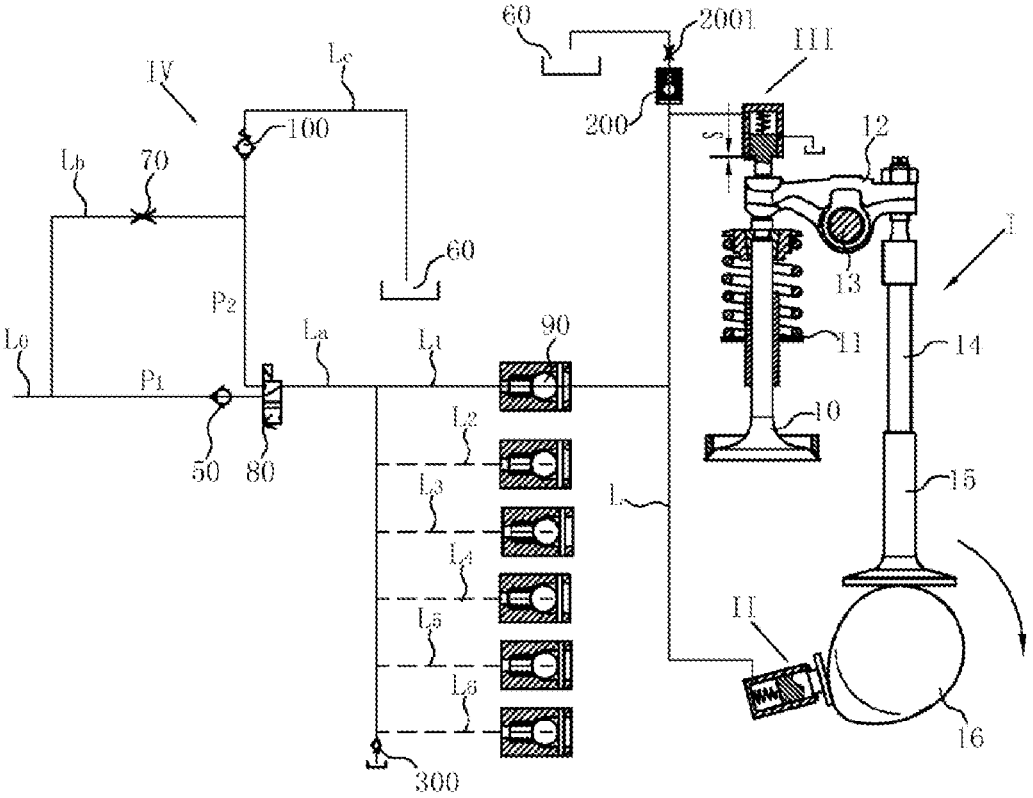
FIG. 1 is a schematic diagram of an in-cylinder braking state of a compression release engine in-cylinder braking system according to Embodiment 1 of the present invention.

In the drawings: I-valve mechanism; II-oil pump device; III-oil cylinder device; IV-oil supply device;

10-valve; 11-valve spring; 12-rocker arm; 13-rocker arm shaft; 14-push rod; 15-tappet; 16-cam; 16*a*-total braking cam;

21-plunger sleeve; 211-plunger sleeve oil inlet and outlet hole; 213-plunger limiting device; 22-plunger; 221-plunger abutting section; 2211-top surface of plunger abutting section; 23-plunger tension spring;

31-cylinder body; 311-cylinder body oil inlet and outlet hole; 312-cylinder body oil-discharging hole; 313-piston limiting device; 32-piston; 321-piston rod; 33-piston tension spring;

50-one-way valve; 60-oil pan; 70-throttling hole; 80-electromagnetic reversing valve; 100-overflow pressure-retaining valve; 200-air release valve; 2001-throttling hole; 300-high-pressure overflow pressure-retaining valve;

90-low-pressure relief valve; 91-valve body; 92-valve ball; 93-compression spring; 94-limiting pin;

L0-engine oil circuit; La-oil supply oil circuit; Lb-pressure reduction oil circuit; Lc-pressure relief oil circuit; L-pressure transmission oil circuit; L1-first-cylinder oil circuit; L2-second-cylinder oil circuit; L3-third-cylinder oil circuit; L4-fourth-cylinder oil circuit; L5-fifth-cylinder oil circuit; L6-sixth-cylinder oil circuit; A-plunger sleeve oil cavity; B-cylinder body oil cavity.

DETAILED DESCRIPTION OF THE EMBODIMENTS

The present invention will be further non-restrictively described in detail below with reference to the accompanying drawings and embodiments.

It should be noted that in the specification, terms indicating position, such as "upper", "lower", "top" and "bottom", are shown based on the drawings and are defined for facilitating description. The terms "mounting", "connected" and "connection" should be understood in a broad sense, for example, connection can be mechanical connection or electric connection between elements, or can be direct connection between elements, or can be indirect connection through an intermediate medium. For those of ordinary skill in the art, the specific meanings of the above terms can be understood according to the specific situations.

Embodiment 1

As shown in FIG. 1, a compression release engine in-cylinder braking system according to Embodiment 1 of the present invention is applied to a valve mechanism I of an engine and comprises: an oil pump device II, an oil cylinder device III and an oil supply device IV.

A rocker arm 12 of the valve mechanism I is rotatably mounted on a rocker arm shaft 13. A push rod 14 and a valve 10 are arranged on two sides of the rocker arm shaft 13 respectively. When a tappet 15 and the push rod 14 push the rocker arm 12 from one side to swing around the rocker arm shaft 13 under the action of a cam 16 on a camshaft, the other side of the rocker arm 12 presses the valve 10 and the valve is opened; and after the camshaft rotates by a specified angle, the valve 10 returns under the action of a valve spring 11 and the valve is closed. The above is the process for controlling the action of the valve in the valve mechanism I during normal operation of the engine.

Figure 4:
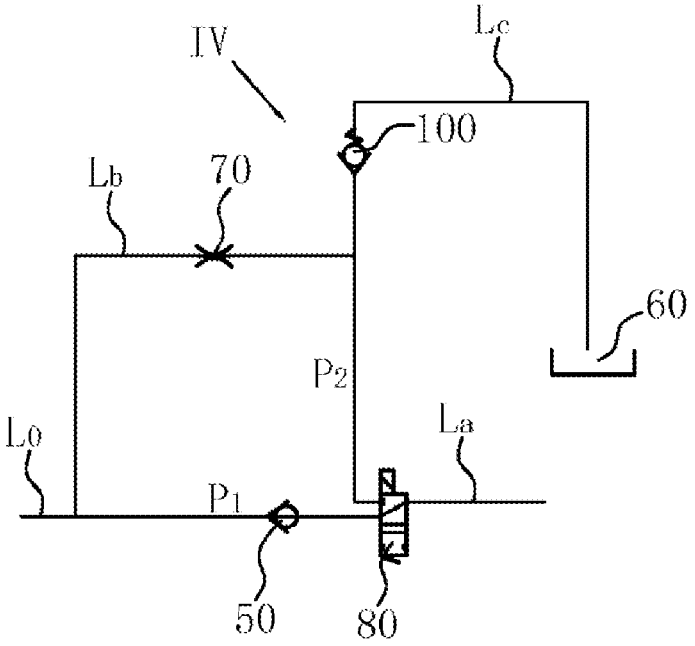
FIG. 4 is a hydraulic principle diagram of an oil supply device in FIG. 1.

As shown in FIG. 4, the oil supply device IV comprises an oil supply oil circuit La, a pressure reduction oil circuit Lb, a pressure relief oil circuit Lc and an electromagnetic reversing valve 80, the number of the electromagnetic reversing valves 80 is set as one, and the braking/non-braking conversion for all air cylinders of the whole engine is realized through one electromagnetic reversing valve 80. Obviously, the number of the electromagnetic reversing valves is not limited to one. Referring to FIG. 1, the number of the electromagnetic reversing valves can also be set as more than one, such as two or three or more. The plurality of electromagnetic reversing valves are connected in parallel for controlling the oil circuits of all cylinders respectively or controlling the oil circuits of all cylinders in groups, thereby realizing multi-stage braking control. The electromagnetic reversing valve 80 is preferably a two-position three-way electromagnetic reversing valve, a one-way valve 50 is further arranged in front of the electromagnetic reversing valve 80, and the one-way valve 50 can further protect an engine oil circuit L0 from being impacted by the returned high-pressure engine oil. An overflow pressure-retaining valve 100 is arranged in the pressure relief oil circuit Lc. For the convenience of description, the engine oil pressure of the engine oil circuit L0 before pressure reduction is defined as P1, the engine oil pressure of the engine after pressure reduction is defined as P2, and the setting pressure of the overflow pressure-retaining valve 100 is P2 or slightly higher than P2.

As shown in FIG. 1, the situation of a six-cylinder engine is shown, wherein each air cylinder is provided with an oil pump device II and an oil cylinder device III, the oil cylinder device III and the oil pump device II communicate with each other through a pressure transmission oil circuit L, the pressure transmission oil circuit L communicates with an oil supply oil circuit La of one shared oil supply device IV through a low-pressure relief valve 90, an air release valve 200 is arranged at the high end (preferably the highest end) of an oil circuit system, and the air release valve 200 is connected to the pressure transmission oil circuit L; during in-cylinder braking, the air release valve 200 is closed; during non-in-cylinder braking, the air release valve 200 is opened, and the engine oil or air in the pressure transmission oil circuit L is discharged continuously through the air release valve 200, thereby avoiding serious influence on the power transmission effect caused by the fact that the air enters the pressure transmission oil circuit L in the shut-down state; and in order to control the discharging speed of the engine oil and avoid the waste of hydraulic oil, a throttling hole 2001 is further arranged behind the air release valve 200, and the throttling hole 2001 communicates with an oil pan 60 of the engine. Specifically, the first cylinder, the second cylinder, the third cylinder, the fourth cylinder, the fifth cylinder and the sixth cylinder communicate with the oil supply oil circuit La respectively through the first-cylinder oil circuit L1, the second-cylinder oil circuit L2, the third-cylinder oil circuit L3, the fourth-cylinder oil circuit L4, the fifth-cylinder oil circuit L5, the sixth-cylinder oil circuit L6 and the low-pressure relief valves 90 in the oil circuits.

The oil circuits of various cylinders between the low-pressure relief valve 90 and the oil supply oil circuit La are jointly connected to one high-pressure overflow pressure-retaining valve 300, the high-pressure overflow pressure-retaining valve 300 communicates with the oil pan 60 of the engine, and the relief pressure of the high-pressure overflow pressure-retaining valve 300 is set to be equal to or slightly higher than the engine oil pressure P1. In the engine compression release mode, when the oil pump device II starts to work, a part of high-pressure engine oil will inevitably return to the engine oil circuit L0 through the low-pressure relief valve 90 to impact the engine oil circuit L0, in the present invention, the returned high-pressure engine oil can be discharged through the high-pressure overflow pressure-retaining valve 300, thereby avoiding impact on the engine oil circuit L0.

A pressure reduction element in the pressure reduction oil circuit Lb adopts a throttling hole 70. Under the condition of reducing the pressure of the engine oil, compared with the pressure reduction valve, the structure adopting the throttling hole is simpler.

Figure 5:
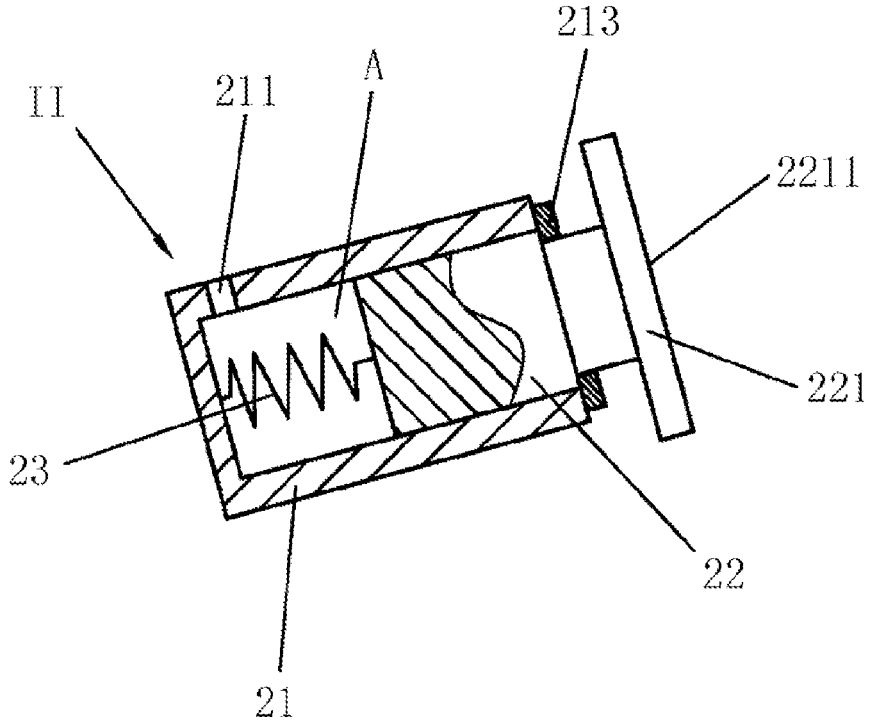
FIG. 5 is a structural schematic diagram of an oil pump device in FIG. 1.

As shown in FIG. 1, the oil pump device II is mounted at a proper position of the cam 16. The reasonable design of the position ensures that the cam 16 acts on the oil pump device II, the oil pump device II pumps oil and pushes a piston 32 in the oil cylinder device III to move and open the valve 10 to realize that the exhaust braking moment is just a moment close to a top dead center of compression stroke. As shown in FIG. 5, the oil pump device II comprises: a plunger sleeve 21, a plunger 22 and a plunger tension spring 23. The bottom of the plunger sleeve 21 is closed and the top of the plunger sleeve 21 is open, a plunger sleeve oil inlet and outlet hole 211 is formed in a sleeve wall of the plunger sleeve 21, and the plunger sleeve oil inlet and outlet hole 211 is connected to the pressure transmission oil circuit L; and a plunger limiting device 213 for limiting the moving position of the plunger 22 is further arranged at the open end of the plunger sleeve 21. The plunger 22 is slidably arranged in an inner cavity of the plunger sleeve 21, a plunger sleeve oil cavity A is formed between the bottom of the plunger 22 and the bottom of the plunger sleeve 21, the plunger sleeve oil inlet and outlet hole 211 communicates with the plunger sleeve oil cavity A, the top of the plunger 22 extends out of the opening of the plunger sleeve 21, the plunger 22 comprises a plunger large-diameter section located in the inner cavity of the plunger sleeve 21 and a plunger small-diameter section connected to the plunger large-diameter section, a plunger step is formed at the transition position of the plunger large-diameter section and the plunger small-diameter section, the plunger 22 further comprises a plunger abutting section 221 located outside the plunger sleeve 21 and connected to the plunger small-diameter section, the radial size of the plunger abutting section 22 is greater than the radial size of the plunger small-diameter section, and a top surface 2211 of the plunger abutting section can be a flat surface, or can be a cambered surface matched with a cam surface of the cam 16 so as to have larger contact area with the cam 16. The plunger tension spring 23 is located in the plunger sleeve oil cavity A and connected between the bottom of the plunger sleeve 21 and the bottom of the plunger 22. The tensile force of the plunger tension spring 23 is far less than a thrust of the engine oil pressure P1 on the plunger 22, but is far greater than a thrust of the engine oil pressure P2 on the plunger 22.

The plunger limiting device 213 can specifically be a closed ring, or a non-closed ring or a strip, and the shape of the plunger limiting device 213 is not limited herein.

Figure 3:
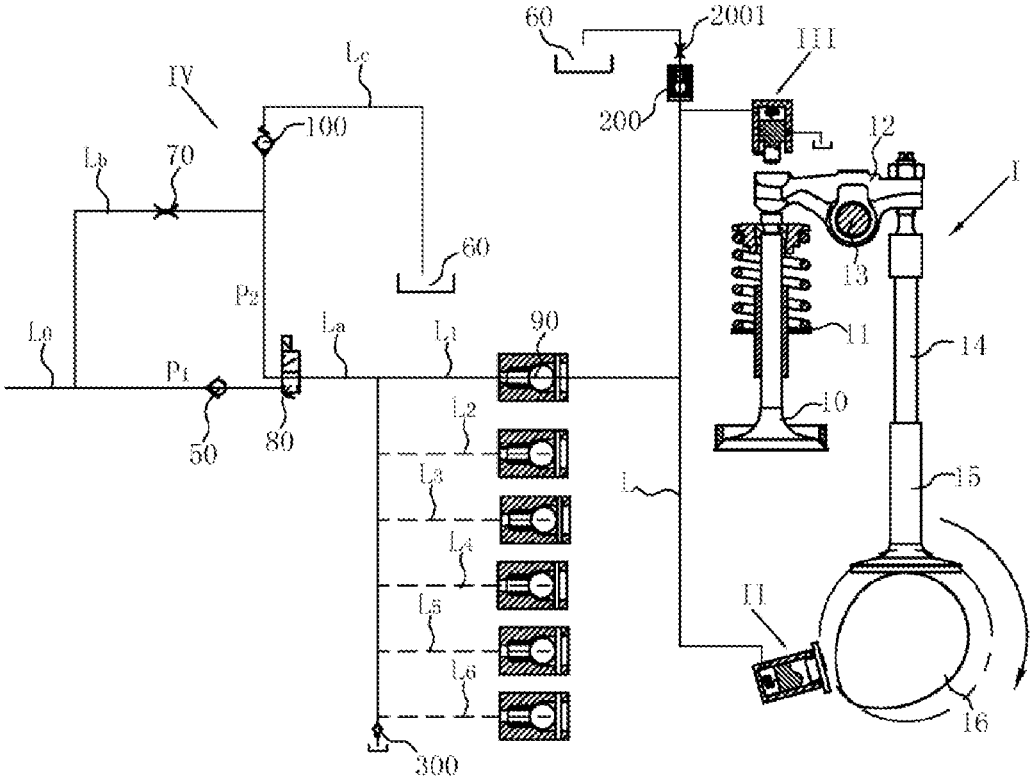
FIG. 3 is a schematic diagram when an engine is in a normal working state according to Embodiment 1 of the present invention.

As shown in FIG. 1, during in-cylinder braking, the plunger limiting device 213 limits the plunger step. As shown in FIG. 3, during non-in-cylinder braking, the plunger limiting device 213 limits the plunger abutting section 221.

The plunger limiting device 213 is fixedly arranged at the open end of the plunger sleeve 21, which is optimized design of the structure of the plunger sleeve 21. Obviously, the open end of the plunger sleeve 21 may also not be provided with the plunger limiting device 213. In this case, a basic circle of the cam 16 can abut against the top surface 2211 of the plunger abutting section to achieve the limiting function.

Figure 6:
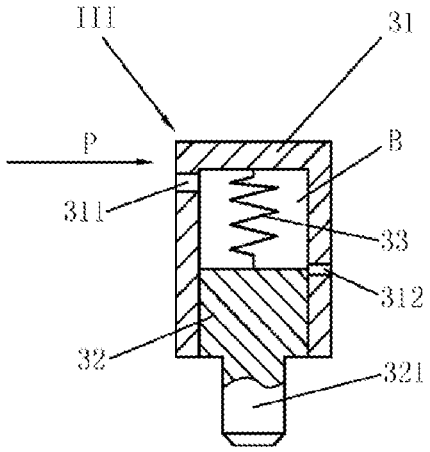
FIG. 6 is a structural schematic diagram of an oil cylinder device in FIG. 1.

As shown in FIG. 1, the oil cylinder device III is mounted at the top of the rocker arm 12 (or other valve mechanisms). As shown in FIG. 6, the oil cylinder device III comprises: a cylinder body 31, a piston 32 and a piston tension spring 33. The cylinder body 31 is fixed relative to the engine, the top of the cylinder body 31 is closed and the bottom of the cylinder body 31 is open, a cylinder body oil inlet and outlet hole 311 is formed in a cylinder wall of the cylinder body 31, and the cylinder body oil inlet and outlet hole 311 is connected to the pressure transmission oil circuit L. The piston 32 is slidably arranged in an inner cavity of the cylinder body 31, a cylinder body oil cavity B is formed between the top of the piston 32 and the top of the cylinder body 31, the cylinder body oil inlet and outlet hole 311 communicates with the cylinder body oil cavity B, a piston rod 321 is arranged at the bottom of the piston 32, a piston step is formed at the transition position of the piston 32 and the piston rod 321, the piston rod 321 extends out of the opening of the cylinder body 31, and the diameter of the piston 32 is reasonably designed, thereby ensuring that a thrust generated by the engine oil pressure P1 of the engine on the piston 32 is far less than the force of the valve spring. The piston tension spring 33 is located in the cylinder body oil cavity B and connected between the top of the cylinder body 31 and the top of the piston 32. The tensile force of the piston tension spring 33 is far greater than the thrust of the engine oil pressure P2 on the piston 32, but far less than the thrust of the engine oil pressure P1 on the piston 32.

As shown in FIG. 6, further, a cylinder body oil-discharging hole 312 is formed in the cylinder wall of the cylinder body 31, and the cylinder body oil-discharging hole 312 communicates with the oil pan 60 of the engine. On one hand, the engine oil in the cylinder body oil cavity B can flow through the cylinder body oil-discharging hole 312 to be discharged partially and take away part of heat, thereby avoiding excessively high temperature of oil in the oil cylinder device III. On the other hand, the cylinder body oil-discharging hole 312 further plays a role in limiting the position of the piston 32. As shown in FIG. 6, a thrust of the engine oil having a pressure of P1 on the piston 32 is greater than an elastic force of the piston tension spring 33, and high-pressure engine oil in the cylinder body oil cavity B pushes the piston 32 to move downward. After the piston 32 moves downward to a certain position, the top edge of the cylinder body oil-discharging hole 312 starts to be higher than the top surface of the piston 32, a part of engine oil will be discharged through the oil discharge area formed by the edge of the oil hole and the top surface of the piston, so that the oil pressure is reduced. The piston 32 continuously moves downward, the oil flowing area formed by the edge of the oil hole and the top surface of the piston is gradually increased, and the oil pressure is continuously reduced. When the oil pressure is reduced to the extent that the thrust on the piston 32 is equal to the elastic force of the piston tension spring 33, the piston 32 will not move downward any more and will stop at a certain position which is a balanced position. At this time, the cylinder body oil-discharging hole 312 plays a role in limiting the piston 32.

Figure 7:
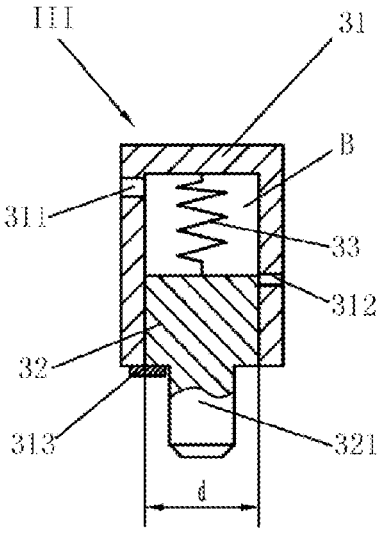
FIG. 7 is another structural schematic diagram of the oil cylinder device in FIG. 1.

As shown in FIG. 7, on the basis of FIG. 6, a piston limiting device 313 for limiting the axial movement of the piston 32 is further arranged at the open end of the cylinder body 31. The design of the piston limiting device 313 ensures that when the piston limiting device 313 limits the piston 32, the top edge of the cylinder body oil-discharging hole 312 is slightly higher than the top surface of the piston 32, but the piston has not yet reached the balanced position. At this time, the cylinder body oil-discharging hole 312 only plays a role in discharging oil and cooling.

The piston limiting device 313 specifically may be a closed ring, or a non-closed ring or a strip, and the shape of the piston limiting device 313 is not limited herein.

Figure 8:
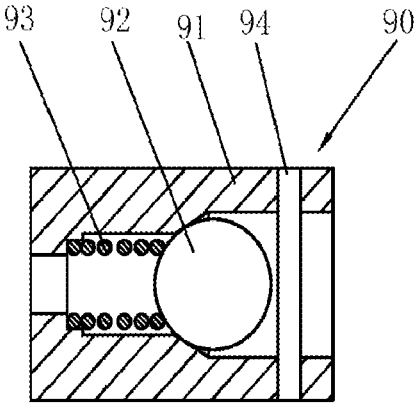
FIG. 8 is a schematic diagram of a low-pressure relief valve in a closed state in FIG. 1.

As shown in FIG. 8, the low-pressure relief valve 90 comprises: a valve body 91, a valve ball 92, a compression spring 93 and a limiting pin 94. The valve body 91 is provided with a valve body oil port I and a valve body oil port II which communicate with a valve cavity of the valve body 91, the valve body oil port I is connected to the pressure transmission oil circuit L, and the valve body oil port II is connected to the oil supply oil circuit La; and the valve ball 92, the compression spring 93 and the limiting pin 94 are all arranged in the valve cavity, the compression spring 93 is clamped between the valve ball 92 and the valve body oil port II, and the limiting pin 94 is located between the valve body oil port I and the valve ball 92.

Figure 9:
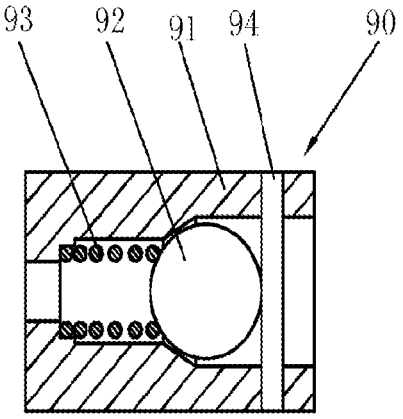
FIG. 9 is a schematic diagram of the low-pressure relief valve in an open state in FIG. 1.

As shown in FIG. 8, if a thrust of the pressure difference between the valve body oil port I and the valve body oil port II of the low-pressure relief valve 90 on the valve ball 92 is greater than an acting force of the compression spring 93, the valve ball 92 seals an inner conical surface of the valve cavity and the low-pressure relief valve 90 is in a closed state. As shown in FIG. 9, on the contrary, if the thrust of the pressure difference between the valve body oil port I and the valve body oil port II of the low-pressure relief valve 90 on the valve ball 92 is less than the acting force of the compression spring 93, the valve ball 92 is separated from the inner conical surface of the valve cavity, the engine oil flows, and the low-pressure relief valve 90 is in an open state.

By designing the spring force of the compression spring 93, it can be designed that only when the pressure difference $\Delta P$ between the valve body oil port I and the valve body oil port II of the low-pressure relief valve 90 exceeds P1, the low-pressure relief valve 90 can be closed.

When the oil pump device II works, the low-pressure relief valve 90 is closed; when the oil pump device II does not work, the low-pressure relief valve 90 is opened; the opening pressure difference of the low-pressure relief valve 90 is greater than P1, but is far less than the pressure P of high-pressure engine oil which is pumped to the oil cylinder device III through the pressure transmission oil circuit L when the oil pump device II works, and the closer the opening pressure difference of the low-pressure relief valve 90 is to P1, the better.

As shown in FIG. 1, FIG. 8 and FIG. 9, the structures and principles of the air release valve 200 and the low-pressure relief valve 90 are basically the same; the air release valve 200 comprises a valve body, a valve ball, a compression spring and a limiting pin, the valve body is provided with a valve body oil port I and a valve body oil port II which communicate with a valve cavity of the valve body, the valve body oil port I is connected to the pressure transmission oil circuit L, and the valve body oil port II is connected to the oil pan 60 of the engine through a throttling hole 2001; the valve ball is arranged in the valve cavity; the compression spring is arranged in the valve cavity and clamped between the valve ball and the valve body oil port II; and the limiting pin is arranged on the valve body and located between the valve body oil port I and the valve ball.

The elastic force of the compression spring in the air release valve 200 on the valve ball is designed to be greater than the acting force of the engine oil pressure P2 of the engine after pressure reduction on the valve ball and less than the acting force of the engine oil pressure P1 of the engine before pressure reduction on the valve ball.

In the in-cylinder braking state, the engine oil pressure of the pressure transmission oil circuit L is P1, and the air release valve 200 is closed. In the non-in-cylinder braking state, the engine oil pressure of the pressure transmission oil circuit L is P2, the air release valve 200 is opened, and the engine oil or air in the pressure transmission oil circuit L is discharged continuously through the air release valve 200 and the throttling hole 2001.

In Embodiment 1, the cam 16 can be an exhaust cam on the camshaft; the cam 16 can also be an intake cam on the camshaft; or the cam 16 can also be a single-cylinder braking cam specially for braking, and the number of the single-cylinder braking cams is the same as the number of the air cylinders of the engine. No matter whether the exhaust cam, the intake cam or the single-cylinder braking cam is adopted, during in-cylinder braking, all the cams can be used to abut against and push the plunger 22 of the oil pump device II so that the pressure of engine oil in the plunger sleeve oil cavity A is increased, high-pressure engine oil is pumped to the oil cylinder device III through the pressure transmission oil circuit L, and the oil cylinder device III pushes the rocker arm 12 to swing downwards to open the valve 10, so that in-cylinder braking is achieved.

The working process of the compression release engine in-cylinder braking system provided by the present invention is as follows:

as shown in FIG. 1, when the engine enters the in-cylinder braking mode, the air release valve 200 is closed. When the basic circle of the cam abuts against the top surface of the plunger of the oil pump device II, the oil pump device II has not worked yet, the pressure of hydraulic oil in the pressure transmission oil circuit L is P1, the pressure difference between two ends of the low-pressure relief valve 90 is zero, and the low-pressure relief valve 90 is opened; and the electromagnetic reversing valve 80 is energized, engine oil having a pressure of P1 of the engine enters the pressure transmission oil circuit L through the one-way valve 50, the electromagnetic reversing valve 80 and the low-pressure relief valve 90 and then enters the oil cylinder device III and the oil pump device II respectively;

under the action of the engine oil pressure P1, the piston 32 in the oil cylinder device III overcomes the force of the piston tension spring 33, and the piston rod 321 extends out and abuts against the top end of the rocker arm 12, but cannot push the valve 10 open;

under the action of the engine oil pressure P1, the plunger 22 in the oil pump device II overcomes the acting force of the plunger tension spring 23, and the plunger step extends to the position of the plunger limiting device 213;

the camshaft rotates, when the camshaft rotates to the position shown in FIG. 1, the bulging part of the cam 16 gradually abuts against the top surface of the oil pump device II and pushes the plunger 22 to move, the pressure of the engine oil in the plunger sleeve oil cavity A of the oil pump device II and the reacting force of the plunger 22 on the cam 16 are increased continuously;

the oil pump device II works and starts to pump oil, high-pressure engine oil having a pressure of P in the pressure transmission oil circuit L is transmitted to the cylinder body oil cavity B of the oil cylinder device III through the pressure transmission oil circuit L, since P>>P1, the pressure difference ΔP between the two ends of the low-pressure relief valve 90 is far greater than P1, the low-pressure relief valve 90 is closed rapidly, the oil cylinder device III starts to work, and the high-pressure engine oil pushes the piston 32 to move downward to open the valve 10 to release pressure; and when the oil pump device II starts to work, a part of high-pressure engine oil will inevitably return to the engine oil circuit L0 through the low-pressure relief valve 90 to impact the engine oil circuit L0, in the present invention, the returned high-pressure engine oil can be discharged through the high-pressure overflow pressure-retaining valve 300, thereby avoiding impact on the engine oil circuit L0.

The cam 16 continues to rotate, after the cam 16 rotates beyond the highest point, the piston 32 moves downward to push the rocker arm 12 to arrive at a limiting position, and at this time, a distance between the piston 32 and the limiting device is S, S is a safe distance and S>0, as shown in FIG. 1. At this time, the cylinder body oil-discharging hole 312 is completely blocked by the piston 32 and does not discharge oil (the pressure of the engine oil in the cylinder body oil cavity B is extremely high, so oil discharge is not expected);

the cam 16 continues to rotate, the top surface of the plunger of the oil pump device II is gradually out of contact with the cam 16, under the action of the engine oil pressure P1, the plunger 22 moves towards the cam 16, the pressure in the plunger sleeve oil cavity A is reduced, the piston 32 in the oil cylinder device III gradually returns to the original position under the action of the force of the valve spring, the valve 10 is closed, and one braking process ends.

Figure 2:
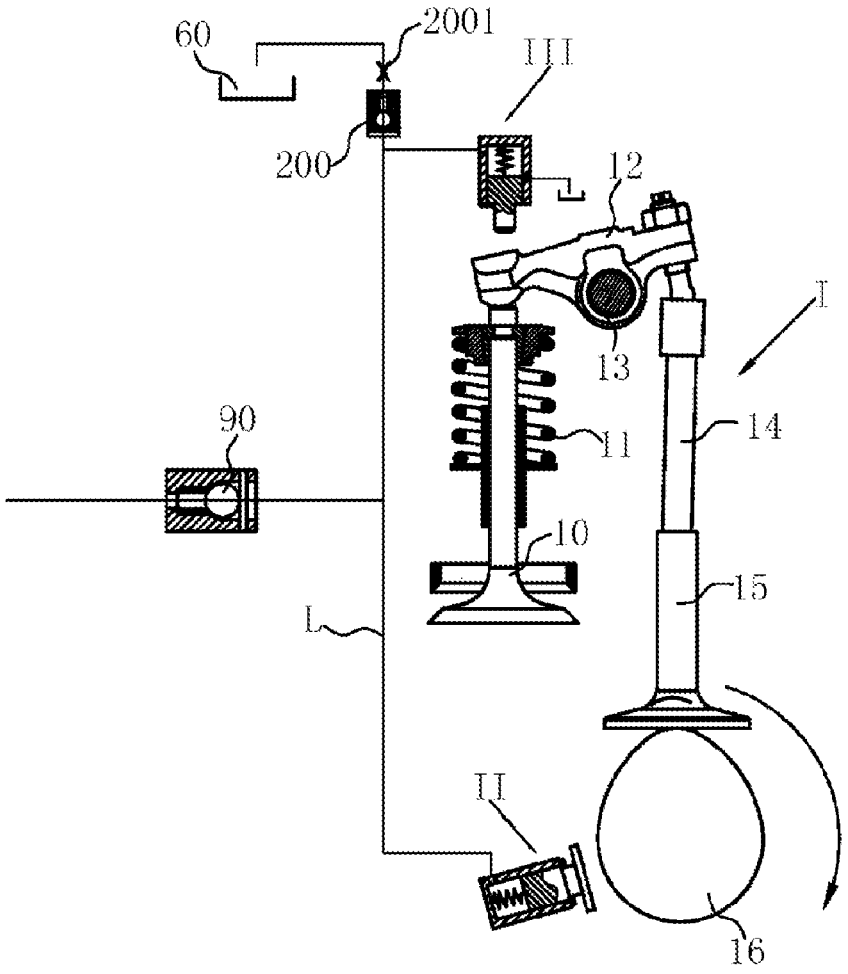
FIG. 2 is a state diagram of an exhaust stroke after in-cylinder braking is completed in FIG. 1.

As shown in FIG. 2, the cam 16 continues to rotate and pushes the tappet 15 and the push rod 14 to move, the top of the rocker arm 12 is separated from the piston rod 321, the piston 32 moves to a limiting position under the action of the engine oil pressure P1, the top surface of the piston 32 is slightly lower than the top edge of the cylinder body oil-discharging hole 312 at this time, and the cylinder body oil-discharging hole 312 starts to discharge oil; and the cam 16 continues to rotate again, the valve 10 is gradually closed, the rocker arm 12, abuts against the piston rod 321 again, the piston 32 is pushed to move upward under the action of the force of the valve spring, and the engine oil in the oil cylinder device III is transmitted into the oil pump device II through the pressure transmission oil circuit L.

In this process, under the reacting force of the piston 32 in the oil cylinder device III on the rocker arm 12, the closing moment of the valve 10 may be delayed slightly, which is advantageous in the in-cylinder braking state. In the subsequent intake stroke, the total charge entering the cylinder can be increased through a certain charge additionally entering the cylinder through the exhaust valve, so that the braking power is improved in the compression stroke.

As shown in FIG. 3, the air release valve 200 is opened, the electromagnetic reversing valve 80 is de-energized, the oil supply device supplies engine oil having a pressure of P2, the pressure of the valve body oil port II of the low-pressure relief valve 90 is P2, and the pressure of the valve body oil port I is still P1 instantly; when the basic circle of the cam abuts against the top surface of the plunger of the oil pump device II, since the pressure of the valve body oil port I of the low-pressure relief valve 90 is not greater than P1, the pressure difference ΔP between the two ends of the low-pressure relief valve 90 is not greater than P1, the low-pressure relief valve 90 is in the open state, hydraulic oil in the pressure transmission oil circuit L flows to the valve body oil port II through the valve body oil port I of the low-pressure relief valve 90, and the pressure transmission oil circuit L rapidly relieves the pressure to P2; and the plunger 22 in the oil pump device II returns under the action of the plunger tension spring 23, the piston 32 in the oil cylinder device III returns to the position shown in FIG. 3 under the action of the piston tension spring 33, and the in-cylinder braking process ends.

The low-pressure relief valve 90 is in the closed state only when the oil pump device II works and is in the open state at other moments.

Embodiment 2

Figure 10:
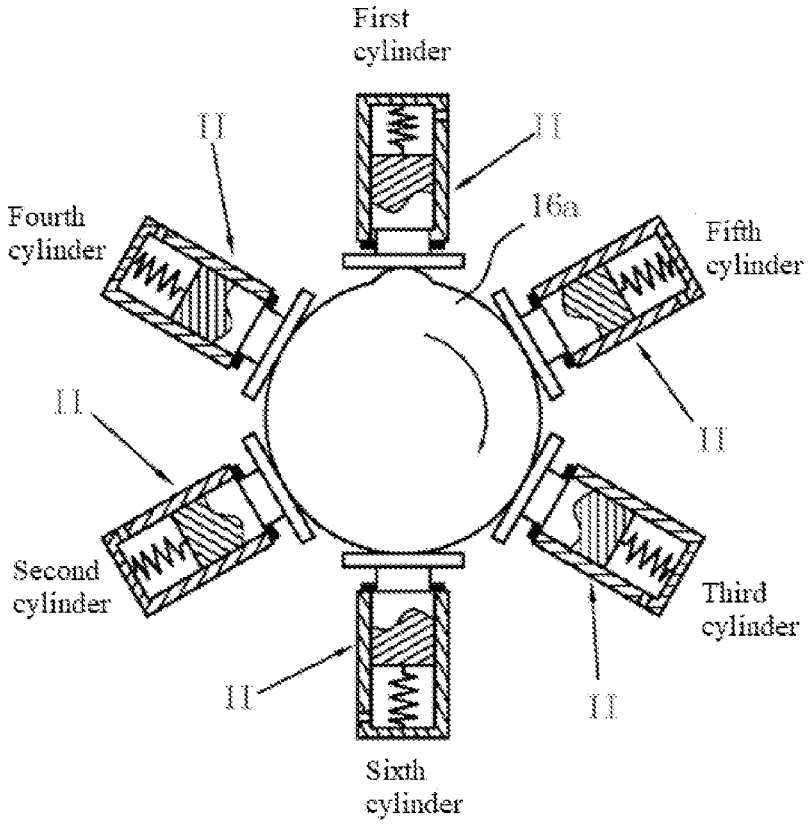
FIG. 10 is a schematic diagram of a compression release engine in-cylinder braking system according to Embodiment 2 of the present invention.

As shown in FIG. 10, the compression release engine in-cylinder braking system provided by Embodiment 2 of the present invention is basically the same as that of Embodiment 1, except the difference that: the cam for abutting against and pushing the plunger 22 of the oil pump device II is a total braking cam 16*a*, the total braking cam 16*a* is a cam additionally arranged at an appropriate position of the camshaft and is different from the original exhaust cam and intake cam on the camshaft; furthermore, the oil pump devices II corresponding to all the air cylinders of the engine are arranged at the periphery of the total braking cam 16*a*, and the number of the oil pump devices II is the same as the number of the air cylinders of the engine.

As shown in FIG. 10, taking a six-cylinder engine as an example, FIG. 10 shows the situation where the oil pump devices II of the six air cylinders of the engine are arranged at the periphery of the total braking cam 16*a*.

Obviously, the compression release engine in-cylinder braking system provided by the present invention is not limited to the six-cylinder engine shown in FIG. 1 and FIG. 10. The compression release engine in-cylinder braking system provided by the present invention is not limited by the number of the air cylinders, and the number of the air cylinders can be increased or reduced on the basis of the six cylinders. The number of the air cylinders can be even-numbered or odd-numbered.

The present invention shows the exhaust braking scheme of the engine with an underneath camshaft. The engine with a side camshaft and the engine with an overhead camshaft can also be implemented with reference to the present invention.

The above embodiments are the examples of the preferred embodiments of the present invention, in which the parts not described in detail are known to those skilled in the art. The protection scope of the present invention is subjected to the content of the claims, and any equivalent changes based on the technical enlightenment of the present invention are within the protection scope of the present invention.

INDUSTRIAL APPLICABILITY

The compression release engine in-cylinder braking system provided by the present invention comprises an oil cylinder device, an oil pump device and an oil supply device that are applied to a valve mechanism of the engine, wherein all air cylinders of the engine share the oil supply device; the oil supply device comprises an electromagnetic reversing valve, an oil supply oil circuit, a pressure reduction oil circuit and a pressure relief oil circuit; each air cylinder of the engine is provided with the oil cylinder device and the oil pump device, the oil cylinder device communicates with the oil pump device through a pressure transmission oil circuit, the pressure transmission oil circuit communicates with the oil supply oil circuit through a low-pressure relief valve, and an air release valve is arranged at the high end of an oil circuit system; during in-cylinder braking, the air release valve is closed and the electromagnetic reversing valve is energized; during non-in-cylinder braking, the air release valve is opened and the electromagnetic reversing valve is de-energized; and the engine is in a normal operation state, and engine oil or air in the pressure transmission oil circuit is discharged continuously through the air release valve, so that the problem that the power transmission effect is seriously affected by the fact that the air enters the pressure transmission oil circuit is solved. Braking/non-braking conversion for all the air cylinders of the whole engine can be realized only by controlling on/off of the electromagnetic reversing valve, so that the requirement on the control circuit is low, the working is stable and reliable and the failure rate is low; and the compression release engine in-cylinder braking system is simple in structure and flexible and convenient in arrangement, and is not limited by the number of the engine cylinders (even and odd numbers are both acceptable).

The oil circuits of various cylinders between the low-pressure relief valve and the oil supply oil circuit are jointly connected to one high-pressure overflow pressure-retaining valve. In the engine compression release mode, when the oil pump device starts to work, a part of high-pressure engine oil which returns through the low-pressure relief valve can be discharged through the high-pressure overflow pressure-retaining valve, so that impact on the main engine oil circuit of the engine is avoided; and the present invention only needs to be provided with one high-pressure overflow pressure-retaining valve, the number of the valves is small, and the structure of the oil circuit system is simpler.

What is claimed is:

1. A compression release engine in-cylinder braking system, wherein the braking system is applied to a valve mechanism of an engine, comprising an oil cylinder device, an oil pump device and an oil supply device, wherein all of a plurality of air cylinders of the engine share the oil supply device;

wherein the valve mechanism comprises a camshaft, a rocker arm and a valve, and the camshaft is provided with a cam;

wherein the oil supply device comprises an electromagnetic reversing valve, an oil supply oil circuit, a pressure reduction oil circuit and a pressure relief oil circuit, and wherein an overflow pressure-retaining valve is arranged in the pressure relief oil circuit, an engine oil pressure of the engine before pressure reduction is defined as P1, and an engine oil pressure of the engine after pressure reduction is defined as P2;

wherein each of the air cylinders is provided with the oil cylinder device and the oil pump device, the oil cylinder device communicates with the oil pump device through a pressure transmission oil circuit, and the pressure transmission oil circuit communicates with the oil supply oil circuit through a low-pressure relief valve;

wherein an air release valve is arranged at a high end of an oil circuit system;

wherein during in-cylinder braking, the air release valve is closed, the electromagnetic reversing valve is energized, and engine oil having a pressure of P1 is supplied to the pressure transmission oil circuit through the oil supply oil circuit: the cam abuts against and pushes the oil pump device, the pressure of engine oil in the oil pump device increases, the oil pump device pumps high-pressure engine oil having a pressure of P to the oil cylinder device through the pressure transmission oil circuit, and the oil cylinder device pushes the rocker arm to open the valve;

wherein during non-in-cylinder braking, the air release valve is opened, the electromagnetic reversing valve is de-energized, and engine oil having a pressure of P2 is supplied to the pressure transmission oil circuit through the oil supply oil circuit: wherein the oil cylinder device and the oil pump device return respectively, and the cam is out of contact with the oil pump device; and wherein when the oil pump device works, the low-pressure relief valve is closed, and when the oil pump device does not work, the low-pressure relief valve is opened, and wherein an opening pressure difference of the low-pressure relief valve is greater than P1, and less than P.

2. The compression release engine in-cylinder braking system according to claim 1, characterized in that the air release valve comprises:

a valve body, provided with a valve body oil port I and a valve body oil port II which communicate with a valve cavity of the valve body, wherein the valve body oil port I is connected to the pressure transmission oil circuit, and the valve body oil port II is connected to an oil pan of the engine;

a valve ball, arranged in the valve cavity;

a compression spring, arranged in the valve cavity and clamped between the valve ball and the valve body oil port II; and a limiting pin, arranged on the valve body and located between the valve body oil port I and the valve ball, wherein an elastic force of the compression spring of the air release valve on the valve ball is greater than an acting force of the engine oil pressure P2 of the engine after pressure reduction on the valve ball and is less than an acting force of the engine oil pressure P1 of the engine before pressure reduction on the valve ball.

3. The compression release engine in-cylinder braking system according to claim 2, characterized in that a throttling hole is arranged behind the air release valve, and the throttling hole communicates with the oil pan of the engine.

4. The compression release engine in-cylinder braking system according to claim 1, characterized in that oil circuits of the plurality of cylinders between the low-pressure relief valve and the oil supply oil circuit are jointly connected to a high-pressure overflow pressure-retaining valve, and the high-pressure overflow pressure-retaining valve communicates with an oil pan of the engine.

5. The compression release engine in-cylinder braking system according to claim 1, characterized in that a one-way valve is connected in front of the electromagnetic reversing valve.

6. The compression release engine in-cylinder braking system according to claim 1, characterized in that a throttling hole is arranged in the pressure reduction oil circuit.

7. The compression release engine in-cylinder braking system according to claim 1, characterized in that the oil pump device comprises:

a plunger sleeve, wherein a bottom of the plunger sleeve is closed, a top of the plunger sleeve is open, a plunger sleeve oil inlet and outlet hole is formed in a sleeve wall of the plunger sleeve, and the plunger sleeve oil inlet and outlet hole is connected to the pressure transmission oil circuit;

a plunger, slidably arranged in an inner cavity of the plunger sleeve, wherein a plunger sleeve oil cavity is formed between a bottom of the plunger and the bottom of the plunger sleeve, the plunger sleeve oil inlet and outlet hole communicates with the plunger sleeve oil cavity, a top of the plunger extends out of an opening of the plunger sleeve, the top of the plunger is in contact with the cam during in-cylinder braking, and the top of the plunger is out of contact with the cam during non-in-cylinder braking; and a plunger tension spring, located in the plunger sleeve oil cavity and connected between the bottom of the plunger sleeve and the bottom of the plunger, wherein a plunger limiting device is arranged at an open end of the plunger sleeve; the plunger comprises a plunger large-diameter section located in the inner cavity of the plunger sleeve and a plunger small-diameter section connected to the plunger large-diameter section; a plunger step is formed at a transition position between the plunger large-diameter section and the plunger small-diameter section; and during in-cylinder braking, the plunger limiting device limits the plunger step, and wherein the plunger further comprises a plunger abutting section located outside the plunger sleeve and connected to the plunger small-diameter section; during in-cylinder braking, a top surface of the plunger abutting section abuts against the cam; and during non-in-cylinder braking, the top surface of the plunger abutting section is out of contact with the cam, and the plunger limiting device limits the plunger abutting section.

8. The compression release engine in-cylinder braking system according to claim 1, characterized in that the oil cylinder device comprises:

a cylinder body, wherein a top of the cylinder body is closed, a bottom of the cylinder body is open, a cylinder body oil inlet and outlet hole is formed in a cylinder wall of the cylinder body, and the cylinder body oil inlet and outlet hole is connected to the pressure transmission oil circuit;

a piston, slidably arranged in an inner cavity of the cylinder body, wherein a cylinder body oil cavity is formed between a top of the piston and the top of the cylinder body, the cylinder body oil inlet and outlet hole communicates with the cylinder body oil cavity, a piston rod is arranged at a bottom of the piston, the piston rod extends out of an opening of the cylinder body, a bottom of the piston rod is in contact with the rocker arm and presses down the rocker arm to open the valve during in-cylinder braking, and the bottom of the piston rod is out of contact with the rocker arm during non-in-cylinder braking; and a piston tension spring, located in the cylinder body oil cavity and connected between the top of the cylinder body and the top of the piston, wherein a cylinder body oil-discharging hole is formed in the cylinder wall of the cylinder body, the cylinder body oil-discharging hole communicates with an oil pan of the engine; during in-cylinder braking, the piston moves downward, and the cylinder body oil-discharging hole does not communicate with the cylinder body oil cavity when the oil pump device works; when the cam pushes the valve open by means of the valve mechanism and the oil pump device does not work, the cylinder body oil-discharging hole communicates with the cylinder body oil cavity; and during non-in-cylinder braking, the piston plugs the cylinder body oil-discharging hole under an action of the piston tension spring, wherein a piston limiting device is arranged at an open end of the cylinder body; a piston step is formed at a transition position between the piston and the piston rod; and when the oil pump device works during in-cylinder braking, the piston limiting device does not limit the piston step, and a distance between the piston step and the piston limiting device is S and S>0, and wherein when the cam pushes the valve open by means of the valve mechanism and the oil pump device does not work, the piston limiting device limits the piston step, and S=0.

9. The compression release engine in-cylinder braking system according to claim 1, characterized in that the low-pressure relief valve comprises:

a valve body, provided with a valve body oil port I and a valve body oil port II which communicate with a valve cavity of the valve body, wherein the valve body oil port I is connected to the pressure transmission oil circuit, and the valve body oil port II is connected to the oil supply oil circuit;

a valve ball, arranged in the valve cavity;

a compression spring, arranged in the valve cavity and clamped between the valve ball and the valve body oil port II; and a limiting pin, arranged on the valve body and located between the valve body oil port I and the valve ball.

10. The compression release engine in-cylinder braking system according to claim 1, characterized in that the cam is an exhaust cam, an intake cam, or a single-cylinder braking cam.

11. The compression release engine in-cylinder braking system according to claim 1, characterized in that the cam is a total braking cam, the oil pump device is arranged at a periphery of the total braking cam, and a number of the oil pump devices is provided and is the same as a number of the air cylinders of the engine.

* * * * *